US006457270B1

(12) United States Patent
Stark, III et al.

(10) Patent No.: US 6,457,270 B1
(45) Date of Patent: Oct. 1, 2002

(54) UNIVERSAL EMERGENCY SIGN

(75) Inventors: Frederick W. Stark, III, 106 Boone Cir., Westbrook, CT (US) 06498; Willfred Goldschmidt, Weston, CT (US); Kurt P. Kowal, Bozrah, CT (US); Jeff M. Mullally, Milford, CT (US); Irving Schaffer, Fairfield, CT (US)

(73) Assignee: Frederick W. Stark, III, Westbrook, CT (US)

( * ) Notice: Subject to any disclaimer, the term of this patent is extended or adjusted under 35 U.S.C. 154(b) by 29 days.

(21) Appl. No.: 09/697,393

(22) Filed: Oct. 27, 2000

(51) Int. Cl.[7] ..... G09F 13/06

(52) U.S. Cl. ..... 40/570; 40/572; 40/580; 362/812

(58) Field of Search ..... 40/564, 570, 572, 40/580, 492, 747; 362/812; 248/289.11, 291.1

(56) References Cited

U.S. PATENT DOCUMENTS

| | | | | | |
|---|---|---|---|---|---|
| 1,148,341 | A | * | 7/1915 | Spencer | 40/570 |
| 1,543,168 | A | * | 6/1925 | Larose | 40/572 |
| 3,591,941 | A | | 7/1971 | Jaffe, Jr. | |
| 3,931,689 | A | | 1/1976 | Shine | |
| 4,164,009 | A | | 8/1979 | Maguire, Jr. et al. | 362/127 |
| 4,271,621 | A | | 6/1981 | Garcia et al. | 40/570 |
| 4,384,316 | A | | 5/1983 | de Vos et al. | 362/147 |
| 4,464,707 | A | | 8/1984 | Forrest | 362/222 |
| 4,748,548 | A | | 5/1988 | Barton | 362/249 |
| 5,022,627 | A | | 6/1991 | Beghelli | 248/558 |
| 5,376,020 | A | | 12/1994 | Jones | 439/537 |
| 5,526,251 | A | | 6/1996 | Andre et al. | 362/396 |
| 5,640,792 | A | * | 6/1997 | Smith et al. | 40/570 X |
| 5,788,363 | A | | 8/1998 | Kamaya et al. | 362/285 |
| 5,950,340 | A | * | 9/1999 | Woo | 40/570 X |
| 5,954,423 | A | * | 9/1999 | Logan | 40/570 X |
| 5,964,051 | A | | 10/1999 | Loeber et al. | 40/570 |

FOREIGN PATENT DOCUMENTS

| | | |
|---|---|---|
| GB | 2 226 682 A | 7/1990 |

* cited by examiner

*Primary Examiner*—Brian K. Green
(74) *Attorney, Agent, or Firm*—Alix, Yale & Ristas, LLP

(57) ABSTRACT

An emergency sign including a vertically extending sign body having a lower panel portion and an upper container portion. The panel portion includes laterally spaced right and left panels where at least one of the panels has a stencil forming the sign display. The upper container portion is in optical communication with the display and forms a longitudinally extending container. A light module disposed within the container portion of the housing has multiple light emitting diodes for illuminating the display. A swivel mounting assembly pivotally connects the container portion of the housing to a mounting plate assembly which receives a mechanical mounting member of the external electrical supply to mount the sign to a structure.

22 Claims, 11 Drawing Sheets

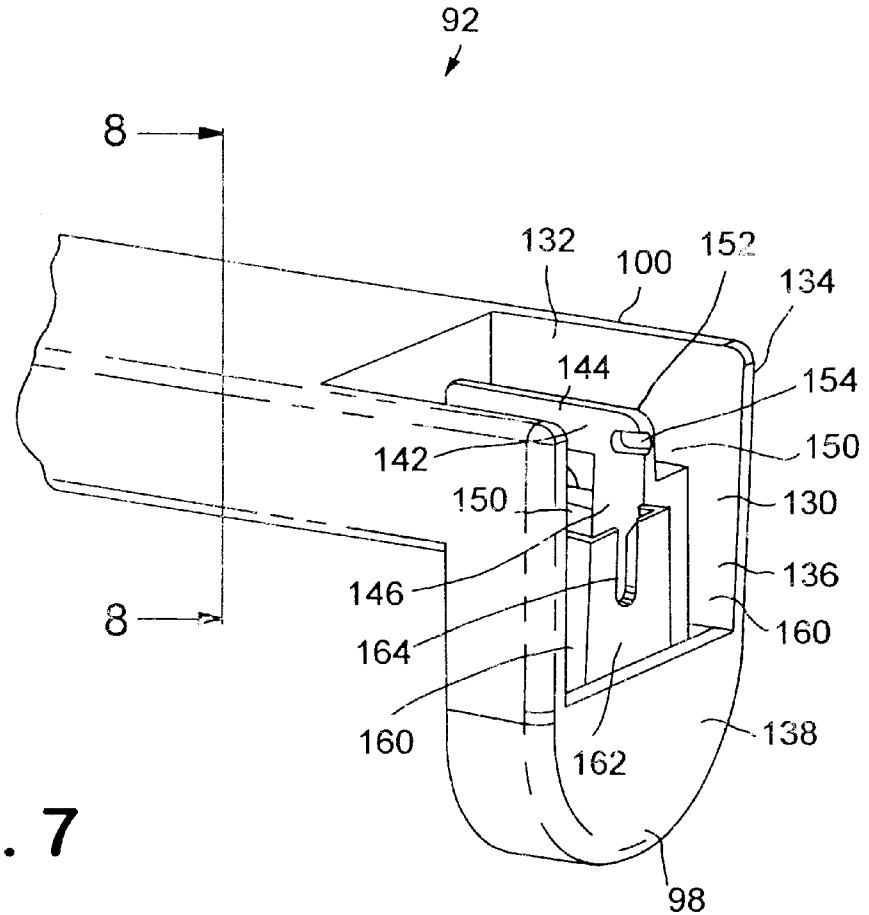
FIG. 7
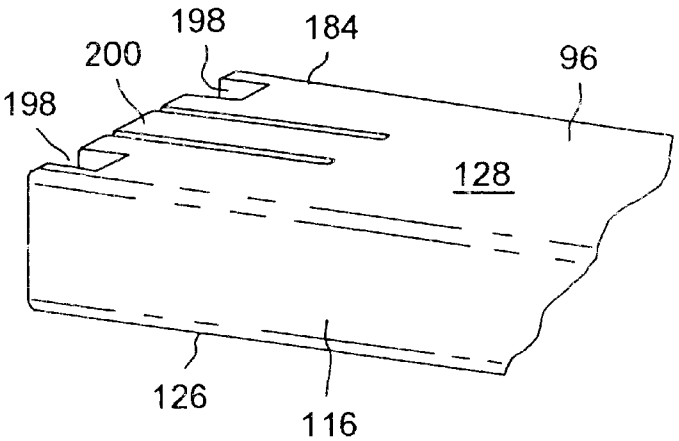

UNIVERSAL EMERGENCY SIGN

BACKGROUND OF THE INVENTION

This invention relates generally to internally illuminated signs. More particularly, the present invention relates to internally illuminated emergency signs, such as exit signs.

Most prior art emergency signs include housings for containing all of the internal components of the sign. Such housings are generally comprised of multiple independent parts, which are held together by screws, clips, and other such fasteners. Since these emergency signs are generally mounted to ceilings or to walls at or near the ceiling, difficulties arise in assembling the sign housings with the various screws required to hold the housing together. Another problem arises when bulbs or the auxiliary power supply of the sign must be replaced, since the housing must be substantially disassembled in order to change the bulbs or power supply.

Furthermore, most prior art emergency signs are separately manufactured for a particular manner of mounting the sign housing.

Consequently, each emergency sign must be individually purchased, depending upon whether it is to be flush-mounted to the ceiling, flush-mounted to a wall, or suspended from a ceiling or wall away from an adjacent wall.

SUMMARY OF THE INVENTION

Briefly stated, the invention in a preferred form is an emergency sign which includes a vertically extending sign body having a lower panel portion and an upper container portion. The panel portion includes laterally spaced right and left panels where at least one of the panels has a stencil forming the sign display. The upper container portion is in optical communication with the display and forms a longitudinally extending container. A light module disposed within the container portion of the housing has multiple light emitting diodes for illuminating the display. The light module receives its primary power from an external electrical supply. A swivel mounting assembly pivotally connects the container portion of the housing to a mounting plate assembly which receives a mechanical mounting member of the external electrical supply to mount the sign to a structure.

The right and left inner, side surfaces of the container have oppositely disposed, longitudinally extending channels. An electrical connector receiving power from the external electrical supply is mounted proximate to a first end of the container. In addition to the light emitting diodes, the light module includes a circuit board, an electrical circuit carried on the circuit board, and at least one circuit component. The side edges of the circuit board are slidingly received in the channels of the container to mount the light module within the container such that male electrical pins in the distal end portion of the circuit board are positioned for engagement by the female electrical receptacles of the electrical connector. The electrical circuit, light emitting diodes, and circuit component are positioned on the circuit board at a distance from the proximal end of the circuit board such that the circuit board must be moved longitudinally a sufficient distance to disengage the male pins from the female receptacles before the electrical circuit, the light emitting diodes, or the other circuit components are withdrawn from the container.

The swivel mounting assembly includes a swivel mounting member having a longitudinally extending platform having and an integral first swivel mount which extends laterally from the first end portion of the platform. A second swivel mount is mounted to the second end portion of the swivel mounting member. The first and second swivel mounts each have at least one positioning tab which extends longitudinally into the first and second ends of the container, respectively, to pivotally mount the swivel mounting assembly to the sign body.

It is an object of the invention to provide a new and improved emergency sign.

It is also an object of the invention to provide an emergency sign that may be mounted to a horizontal ceiling, a vertical wall, or a slanted ceiling/wall without the use of additional components and without extensive modification.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which:

FIG. 7 is an enlarged perspective view of the swivel mount member of FIG. 1 with the middle portion removed;

DETAILED DESCRIPTION OF THE PREFERRED EMBODIMENT

Figure 1:
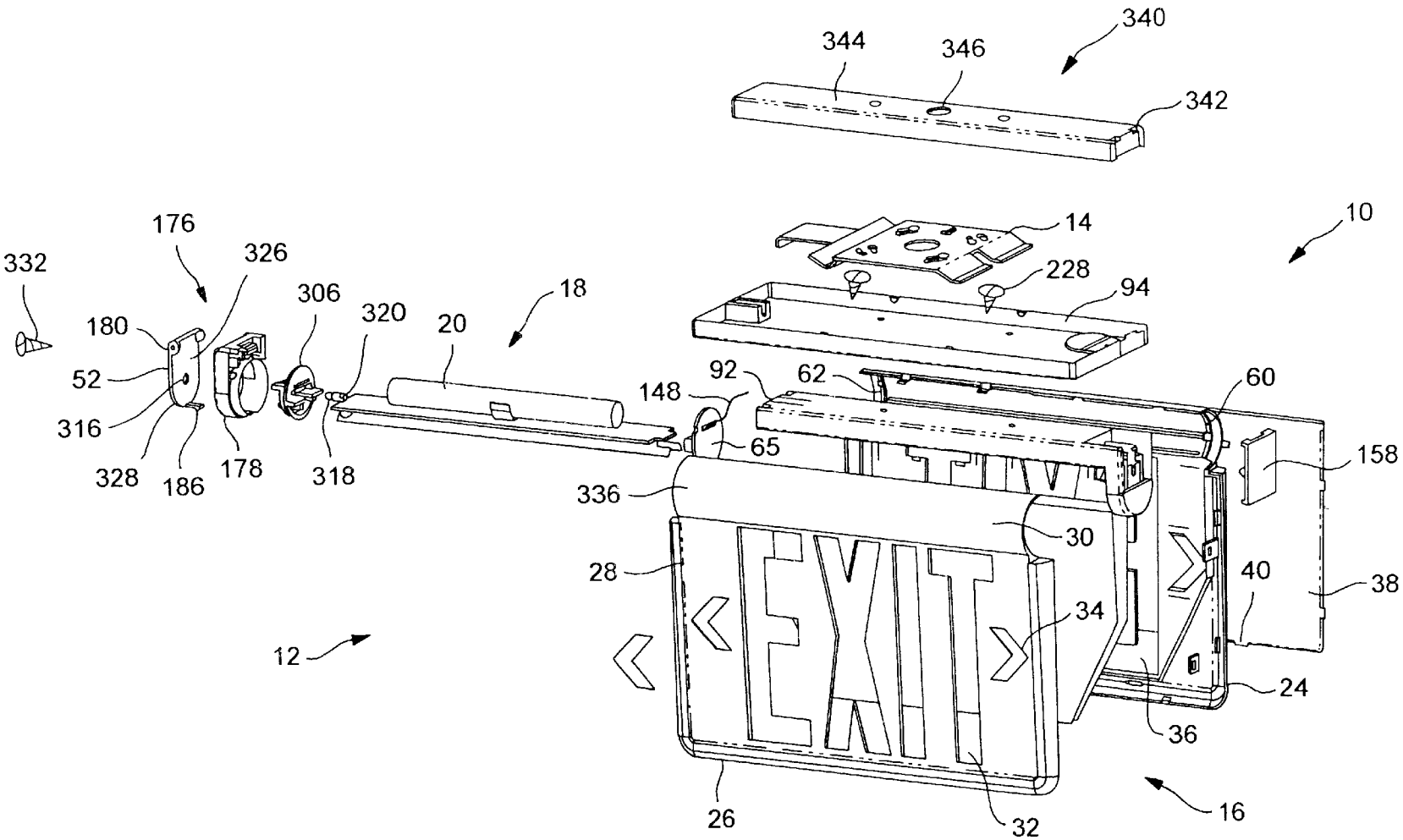
FIG. 1 is an exploded, perspective view of an exit sign in accordance with the subject invention.

With reference to the drawings wherein like numerals represent like parts throughout the several figures, an emergency sign in accordance with the present invention is generally designated by the numeral 10. The emergency sign 10 includes a sign body 12 which may be mounted to a wall or ceiling by a universal mounting canopy 14. The sign body 12 comprises a housing 16, which forms the sign display and houses the light module 18 and auxiliary power supply 20, which is pivotally connected to the mounting canopy 14 by a swivel mounting assembly 22.

The housing 16 includes substantially identical, right and left panel members 24, 26. Each of the panel members 24, 26 has a lower panel portion 28 and an upper, substantially semi-circular, casing portion 30. The panel portions 28 form the sign display, each panel portion 28 incorporating a large cutout stencil 32 having the letters forming the display, for example, "EXIT". For an exit sign 10, chevrons 34 are disposed on either side of the stencil 32 and may be optionally used by removing respective cut outs. A translucent polymer film 36 is mounted to the inner surface of each panel portion 28 such that the film 36 covers the stencil 32 and chevrons 34. The polymer film 36 diffuses the light emitted by the light module. The polymer film 36 may be white, red, green, or any other color, depending on the code requirements for the installation.

A rectangular blanking member 38 has laterally extending locking tabs 40 which may be inserted through the openings of one of the stencils 32 to engage the rear surface of the panel portion 28 such that the blanking member 38 covers and obscures the stencil 32. The blanking member 38 may be mounted on a panel member 24, 26 which is installed adjacent to a wall if it is desirable to block transmission of light through the stencil 32 onto the wall.

The right and left panel members 24, 26 are mounted together such that the casing portions 30 form a cylindrical container 42 having oppositely disposed open ends 44, 46 and a bottom, longitudinally extending opening 48 providing optical communication between the container 42 and the chamber 50 formed by the lower panel portions 28. As explained in greater detail below, an access door 52 provides access to the interior of the container 42. Consequently, the right and left panel members 24, 26 are preferably permanently mounted together.

First and second pairs of circumferential ridges 54, 56 extend laterally inward from the inner surface 58 of the container 42 to form first and second mounting grooves 60, 62 in opposite end portions of the container 42. An indexing tab 64 extends across each groove 60, 62 to facilitate positioning and mounting an endcap 65 within the groove 60 in the first end portion of the container 42. Each pair of ridges 54, 56 is positioned at a longitudinal distance from the end of the container 42 such that the outer surface of the longitudinally outer ridge 54, 56 of each pair can act as a bearing surface.

Upper and lower lips 66, 68 extending laterally inward from the inner surface 58 of each casing portion 30 form a pair of oppositely disposed, longitudinally extending channels 70 in the container 42. The lips 66, 68 are positioned such that the distance between the upper lip 66 and the inner surface 58 of the top of the container 42 is greater than the distance between the lower lip 68 and the inner surface 58 of the bottom of the container 42. The end portions 72 of the upper and lower lips 66, 68 extend upwardly and downwardly, respectively, such that both end portions 72 of each channel 70 flare open towards the adjacent ends 44, 46 of the container 42. The flared channel ends facilitate the insertion of the side edges 74 of a circuit board 76 of the light module 18 for mounting the light module 18 within the container 42. The distance between the top of the channel 70 and the inner surface 58 of the container 42 provides space for receiving the auxiliary power supply 20, which is mounted to the top surface 78 of the circuit board 76, while the distance between the bottom of the channel 70 and the inner surface 58 of the container 42 provides space for receiving circuit components 80 and LEDs 82, which are mounted to the bottom surface 84 of the circuit board 76. An electrical connector 86 mounted on the endcap 65 is positioned such that the female. receptacles of the connector 86 are located to receive male pins 88 which are formed on a distal end portion 90 of the circuit board 76.

The swivel mounting assembly 22 includes a swivel mounting member 92, which provides a pivotal connection between the housing 16 and the mounting canopy 14, and a cover plate 94, which mounts the swivel mounting member 92 to the canopy 14 and decoratively covers the canopy 14. The swivel mounting member 92 includes a longitudinally extending platform 96 having an integral first swivel mount 98 extending laterally from a first end portion 100 and a pair of posts 102 extending downward from the middle portion 104 of the platform 96. Multiple positioning tabs 106, preferably three or more radially spaced tabs, extend longitudinally inward from the inner face 108 of the first swivel mount 98 and are received within the open first end 44 of the container 42 such that the inner ends 110 of the tabs 106 are disposed near and preferably bear on the outer surface of the outer ridge 54, 56. Preferably, one or more of the tabs 106' is positioned proximate to an arcuate bearing surface 112 in the first end portion 100 of the platform 96 such that the first end 44 of the container 42 is received between the tab 106' and the bearing surface 112.

Figure 8:
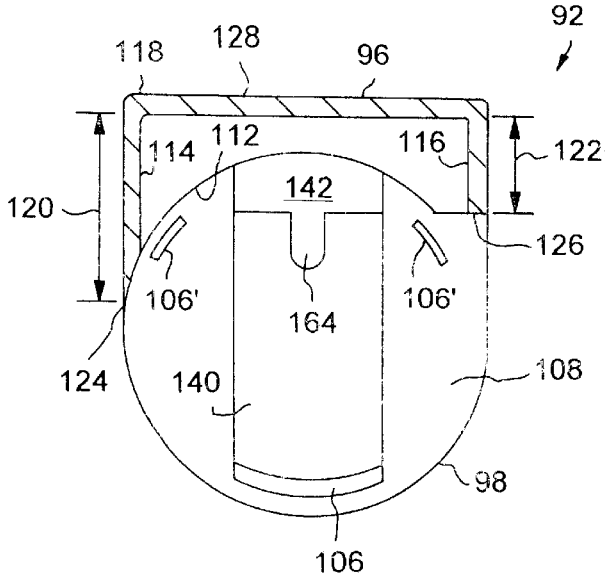
FIG. 8 is an enlarged cross-section view of the swivel mount member taken along line 8—8 of FIG. 7.
Figure 10:
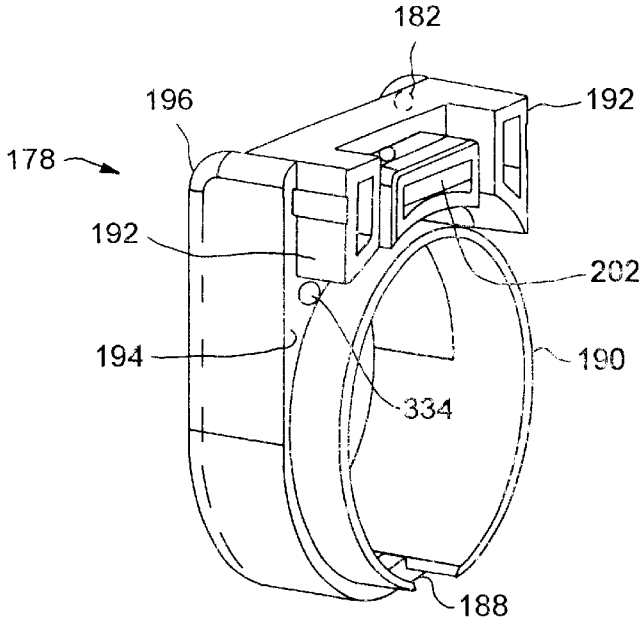
FIG. 10 is an enlarged perspective view, partly in phantom, of the door frame of FIG. 1.
Figure 9:
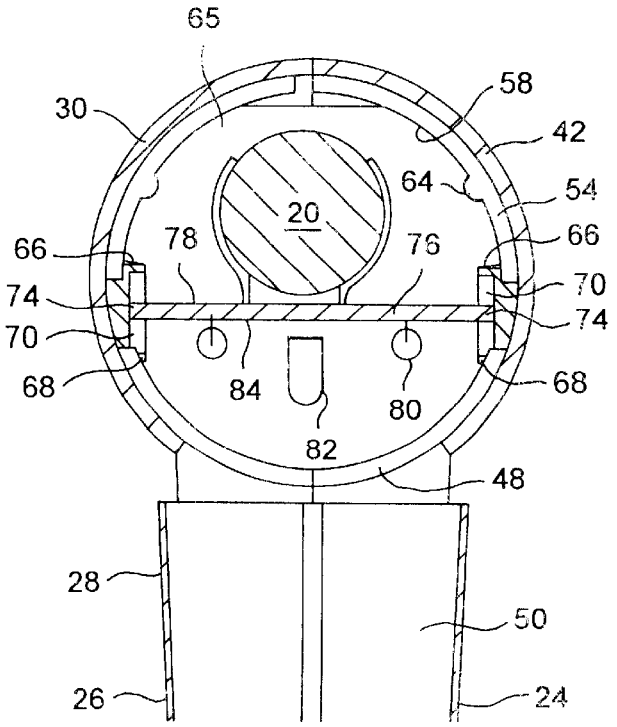
FIG. 9 is an enlarged cross-section view taken along line 9—9 of FIG. 3.
Figure 12A:
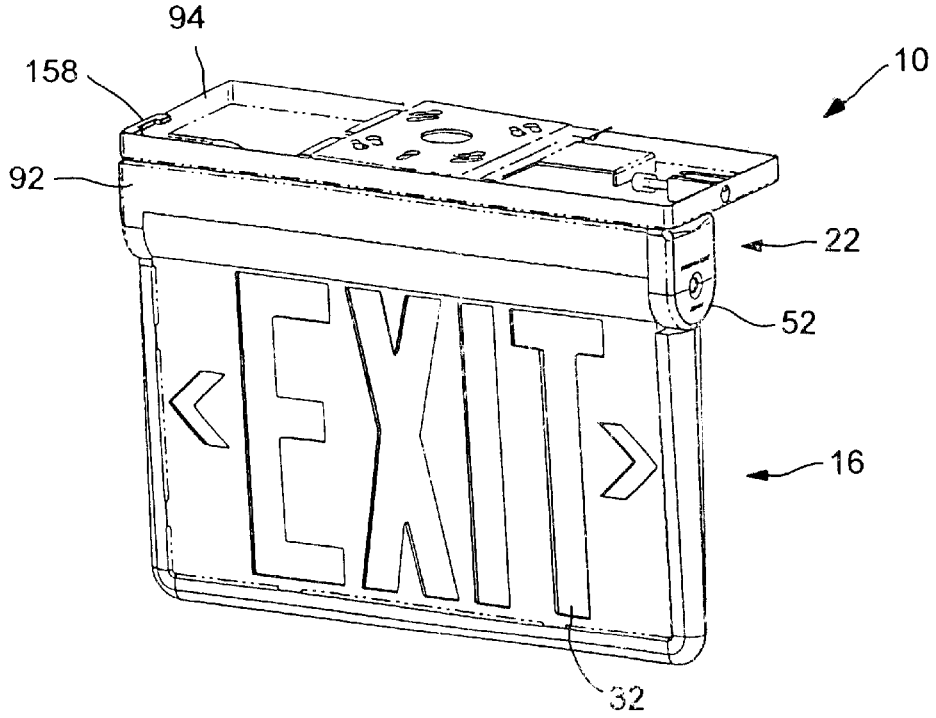
FIGS. 12*a* and 12*b* are perspective views of the exit sign of FIG. 2, illustrating the cover plate in the top mount position and rotated to the ceiling mounting position and the wall mounting position, respectively.
Figure 12B:
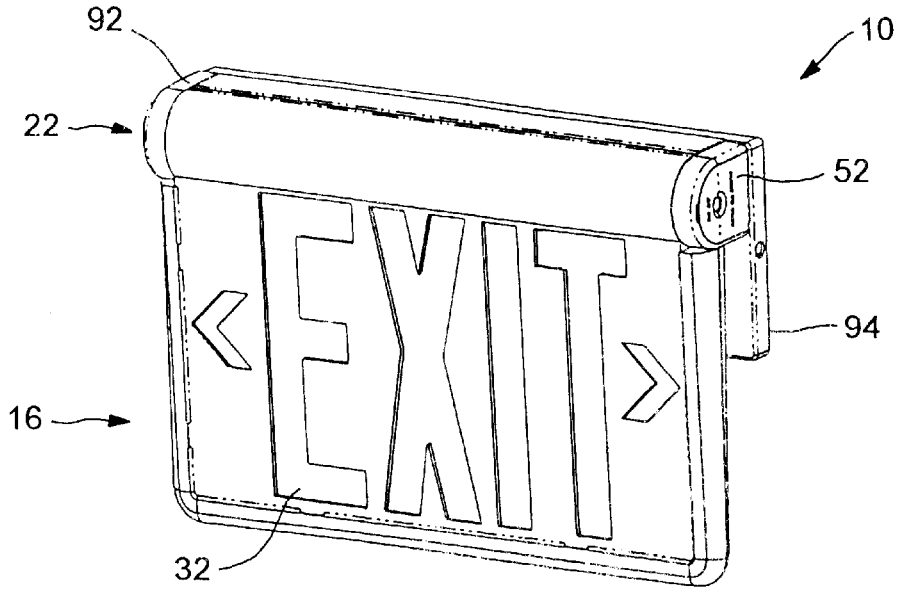
Figure 13:
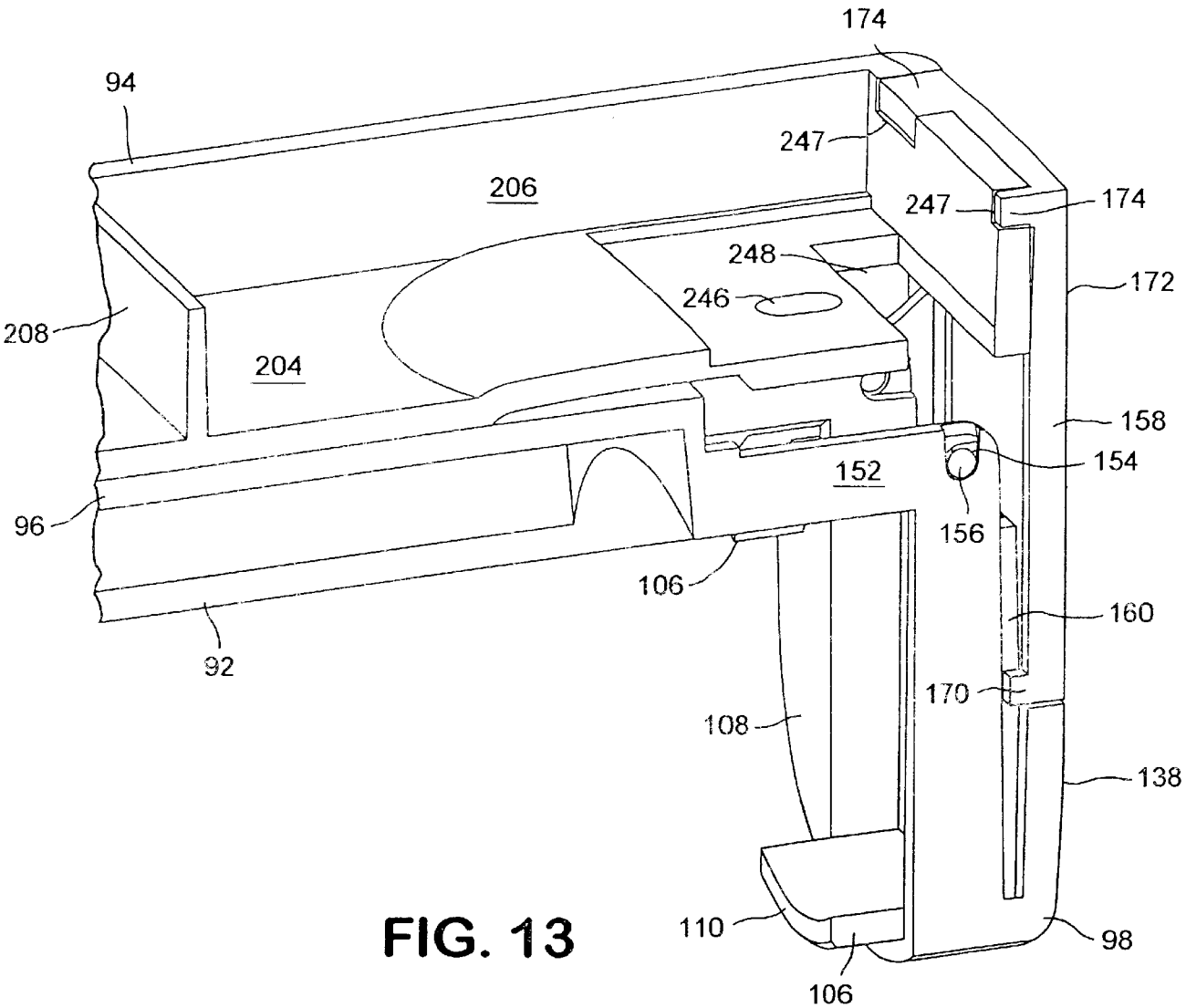
FIG. 13 is an enlarged, partial, perspective view of the cover plate mounted to the light module housing in the top mount position.

First and second skirts 114, 116 extend laterally downward from the side edge portions 118 of the platform 96. As shown in FIG. 8, the height 120 of the first skirt 114 is greater than the height 122 of the second skirt 116. Consequently, the bottom edge 124 of the first skirt 114 will contact the panel portion 28 of the housing 16 when the housing 16 is rotated in the counter-clockwise direction (as viewed in FIG. 1) before the bottom edge 126 of the second skirt 116 contacts panel portion 28 when the housing 16 rotated in the clockwise direction (as viewed in FIG. 1). The reduced height 122 of the second skirt 116 allows the housing 16 to be rotated sufficiently that the plane defined by the upper surface 128 of the platform 96 will be substantially parallel to the joint between the right and left panel members 24, 26, allowing the display to lie parallel to a wall when the sign 10 is mounted as shown in FIG. 12*b*.

A recess 130 in the swivel mounting member 92 has a top segment 132 in the upper surface 128 of the first end portion 100 of the platform 96, extending from the first end 134 of the platform 96, and a side segment 136 in the outer surface 138 of the first swivel mount 98, respectively. A trough 140 in the inner face 108 of the first swivel mount 98 extends laterally upward and communicates with recess 130 via an opening 142 having a top and side segments 144, 146 extending through the platform 96 and first swivel mount 98, respectively. Wires 148 (FIG. 1) extending from the electrical connector 86 mounted on the endcap 65 are received in the trough 140 and extend through the opening 142 and the recess 130, as explained in greater detail below, for connection to a building electrical supply circuit.

Figure 6:
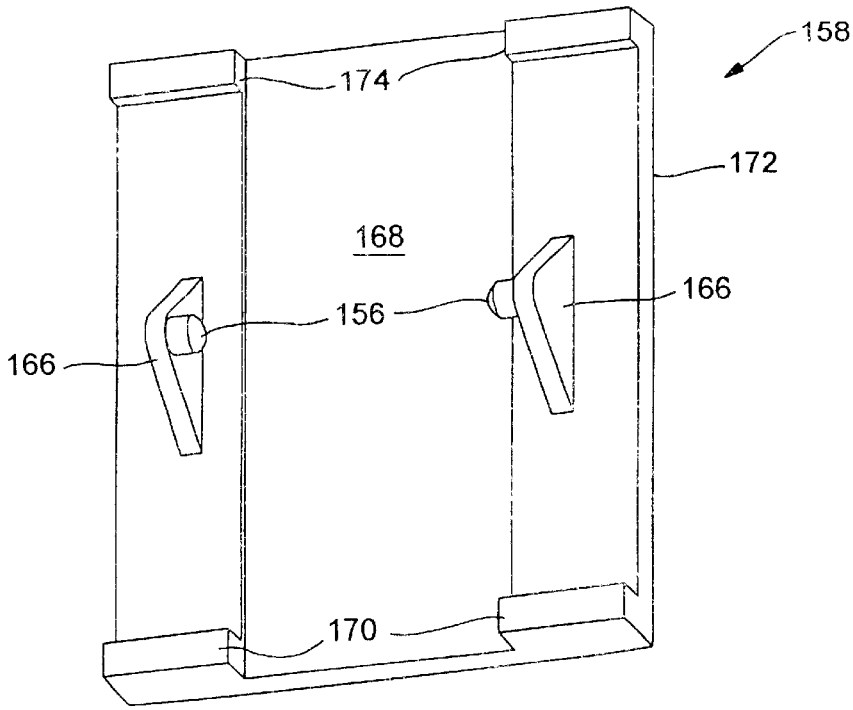
FIG. 6 is an enlarged perspective view of the trim door of FIG. 1.

A pair of grooves 150 in the floor of the top segment 132 of the recess 130 define a pair of longitudinally extending shoulders 152 disposed on either side of the top segment 144 of the opening 142. A transverse hole 154 extends through the distal end portions of each shoulder 152 for receiving mounting pins 156 of a trim door 158 (FIG. 6). A pair of grooves 160 in the wall of the side segment 136 of the recess 130 define a platform 162 having a central, upwardly extending slot 164. The trim door 158 has a pair of laterally spaced posts 166 extending from the inner surface 168. Mounting pins 156 extending from the posts 166 are received in holes 154 to pivotally mount the trim door 158 to the swivel mounting member 92. When the trim door 158 is rotated to its vertical position, a first pair of inwardly extending tabs 170 are received in grooves 160 and the outer surface 172 of the trim door 158 is substantially co-planar with the outer surface 138 of the first swivel mount 98. When the trim door 158 is rotated to its horizontal position, a second pair of inwardly extending tabs 174 are received in grooves 150 and the outer surface 172 of the trim door 158 is substantially co-planar with the upper surface 128 of the platform 96.

An access door assembly 176 is mounted to the second end 46 of the container 42. The access door assembly 176 includes a door frame 178 and the access door 52. Protrusions 180 on the upper part of the access door 52 are received in receptacles 182 in the door frame 178 whereby the door frame 178 acts as a second swivel mount which mounts the access door 52 to the swivel mounting member 92 and pivotally mounts the second end portion 184 of the swivel mounting member 92 to the housing 16. A catch 186 on the lower part of the access door 52 is engageable with an edge 188 of the door frame 178 to lock the access door 52 in the closed position. A circular lip 190 on the door frame 178 is received in the open second end 46 of the container 42 and preferably bears on the outer surface of ridge 54. A pair of indexing tabs 192 extend longitudinally from the inner face 194 of the upper portion 196 of the door frame 178 and are received in a pair of notches 198 extending within the upper surface 128 of the second end portion 184 of the platform 96. A catch 200 formed in the second end portion 184 of the platform 96 is received in a receptacle 202 of the frame 178 to lock the frame 178 and the swivel mounting member 92 to the housing 16.

The cover plate 94 is a longitudinally extending plate 204 having a lip 206 which extends upward from the periphery of the plate 204 to form a cavity for receiving and hiding the canopy 14, whereby the cover plate 94 provides a more aesthetically pleasing appearance to the sign 10. Preferably, one or more stiffening elements 208 extend upward from the inner surface 210 of the plate 204 to provide additional mechanical strength and stiffness to the cover plate 94. First, second, third, and fourth tabs 212, 214, 216, 218 extend inwardly from the upper edge 220 of the lip 206 within the middle segment 222, defining first and second pairs of oppositely disposed, longitudinally spaced tabs. A pair of openings 224 extending through the middle segment 222 of the plate 204 may be positioned above bores 226 in the posts 102 of the swivel mounting member 92 and a pair of screws 228 may be inserted through openings 224 to threadably engage posts 102 to thereby mount the cover plate 94 in the top mount position, as further explained below. A pair of annular ridges 230 coaxially surround openings 224 to receive the heads of the screws 228. Preferably, openings 224 are offset to one side of the cover plate 94 such that the cover plate 94 will not extend vertically past the upper surface 128 of the swivel mounting member 92 when the cover plate 94 is mounted in the top mount position and rotated as shown in FIG. 12*b*, thereby allowing the sign 10 to be mounted closer to the ceiling.

Figure 5:
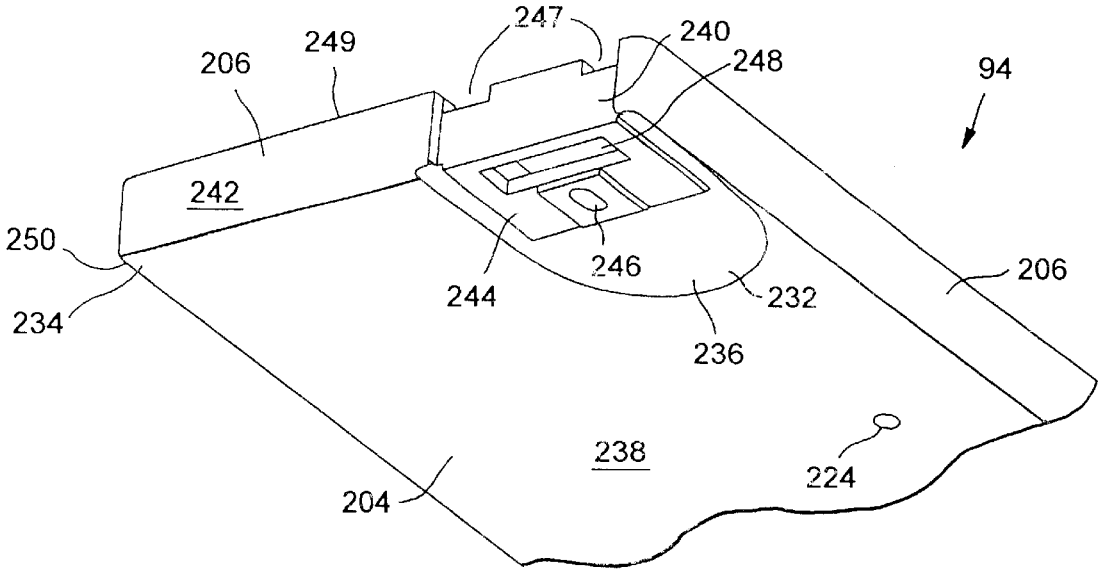
FIG. 5 is an enlarged, partial, perspective view of the cover plate of FIG. 1.

With reference to FIG. 5, a recess 232 in the first end portion 234 of the cover plate 94 has a bottom segment 236 which extends upwardly from the bottom surface 238 of the cover plate 94 and a side segment 240 in the outer surface 242 of lip 206. A platform 244 extending downwardly within the bottom segment 236 has first and second openings 246, 248 extending therethrough. Preferably the first opening 246 has an elliptical shape and the second opening 248 has a rectangular shape. A pair of notches 247 extend through the upper edge 249 of the lip 206 within side segment 240. Recess 232 has a shape which is the mirror image of the outer surface 138 of the first swivel mount 98, whereby the first end 134 of the first swivel mount 98 is received within recess 232 and platform 244 is received within the side segment 136 of recess 130 of the swivel mounting member 92 when the cover plate 94 is mounted in the end mount position, as further explained below. Preferably, recess 232 is offset to the same side of the cover plate as openings 224 for the reason stated above.

Figure 2:
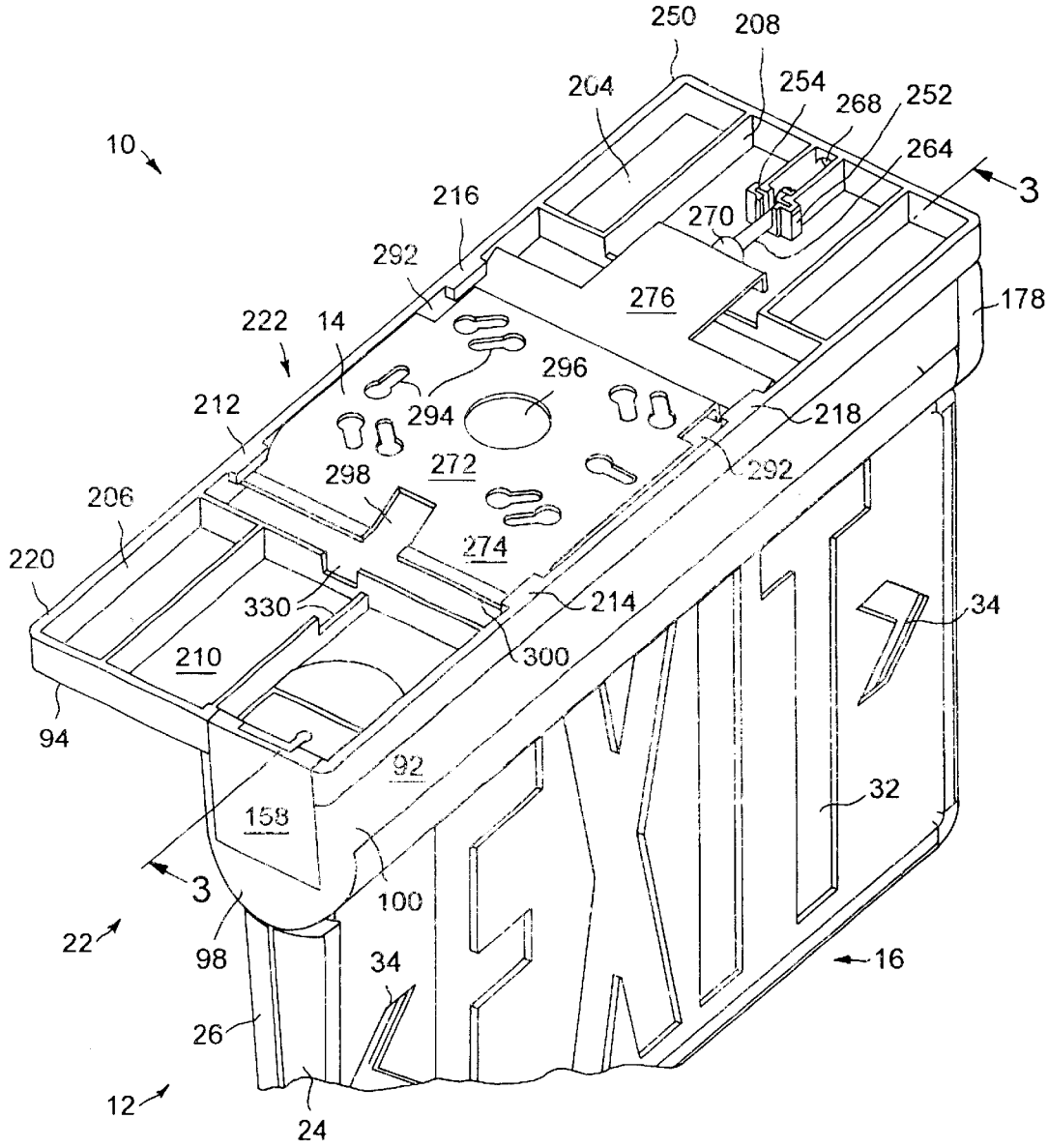
FIG. 2 is an enlarged, partial, perspective view of the assembled exit sign of FIG. 1, illustrating the cover plate mounted in the top mount position.
Figure 3:
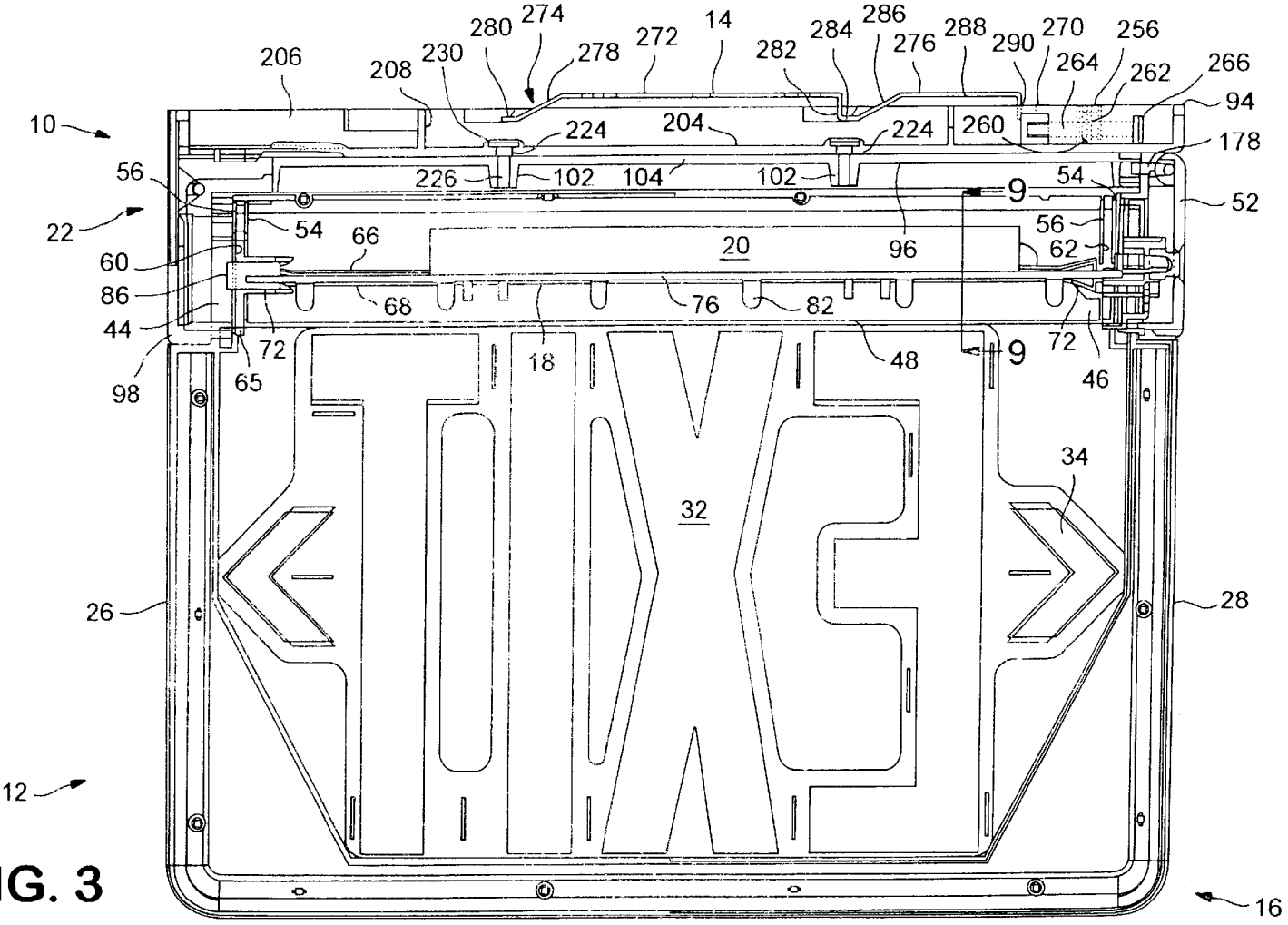
FIG. 3 is a cross-section view taken along line 3—3 of FIG. 2.
Figure 4:
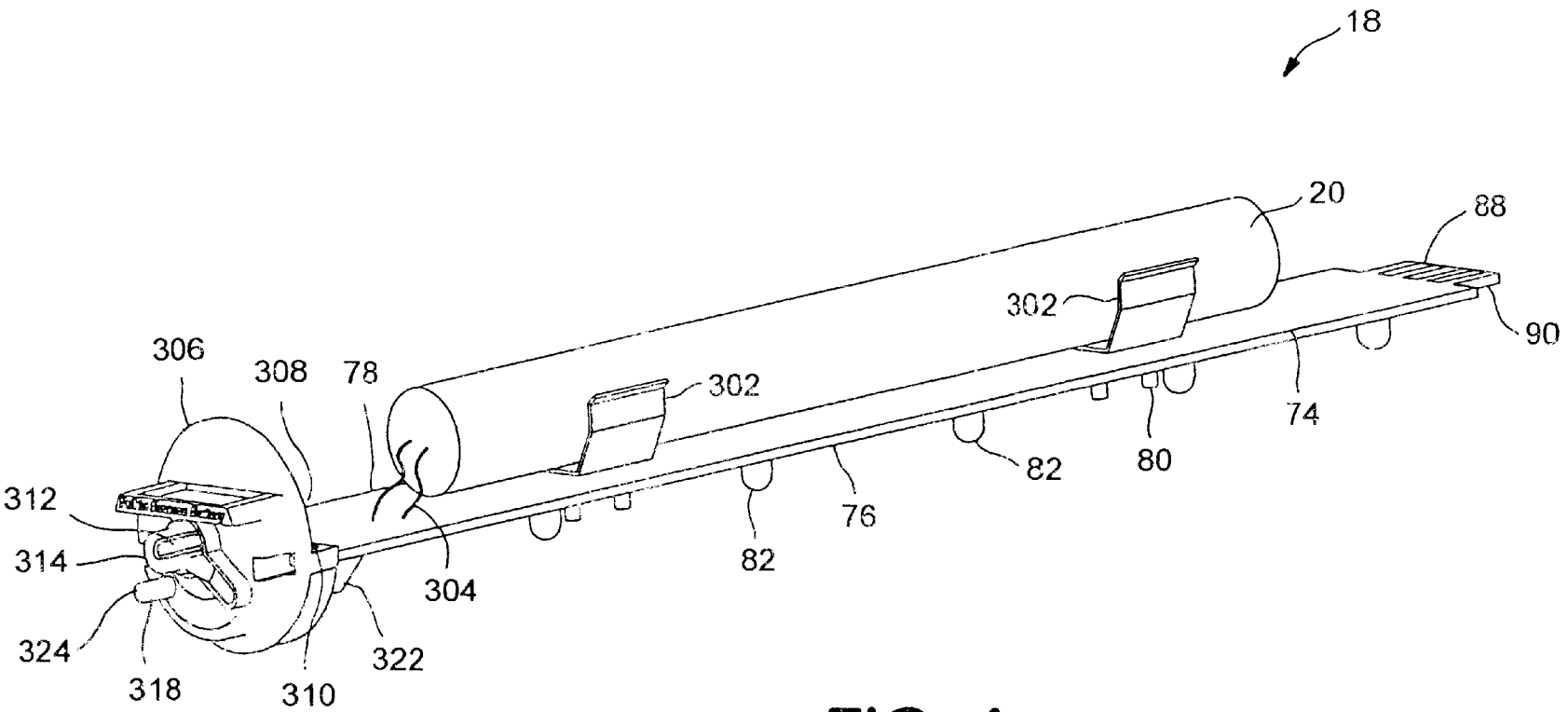
FIG. 4 is an enlarged perspective view of the light module of FIG. 1.

With reference to FIG. 2, the second end portion 250 of the cover plate 94 includes a nut mounting member comprising a pair of posts 252 extending upwardly from the inner surface 210 of the cover plate 94. Oppositely disposed slots 254 in the posts 252 receive the edge portions of a rectangular piece of sheet metal 256. Tangs 260 extending into an opening 262 in the center of the piece of metal 256 act as a thread surface for threadably engaging the threaded shaft 264 of a bolt 266 extending through the opening 262. An opening 268 extending through the lip 206 at the second end 250 of the cover plate 94 provides access to the head of the bolt 266. A bearing member 270 mounted on the end of the threaded shaft 264 may be threadably positioned to engage the canopy 14 as explained further below.

The canopy 14 is preferably formed from sheet metal in a stamping operation and has a center portion 272 disposed between two end portions 274, 276. The first end portion 274 includes a first spacer segment 278 which extends obliquely from the center portion 272 to a first foot segment 280. The second end portion 276 includes a second spacer segment 282 which extends substantially perpendicular from the center portion 272 to a second foot segment 284 and a third spacer segment 286 which extends obliquely upward from the second foot segment 284 to an engagement segment 288. The engagement segment 288 has a downwardly extending bearing portion 290 which defines the proximal end of the canopy 14.

The center portion 272 includes a pair of slots 292 extending from the sides adjacent the second spacer segment 282 of the second end portion 276. The center portion 272 also includes means for receiving a mechanical mounting member of the building electrical system. As shown in FIG. 2, the means may comprise a plurality of mounting holes 294 which are positioned such that at least one, preferably at least two, of the holes 294 will correspond with a mounting bolt of any conventional electrical junction box whereby the mounting bolt may be inserted through the hole 294 and torqued to mount the canopy 1 4 to the junction box in a conventional manner. Electrical services wires extending from the junction box are inserted through a central opening 296 in the center portion 272 and an opening 298 extending through the first spacer segment 278 so that they may be properly received within the cover plate 94 when the remainder of the sign 10 is installed.

The cover plate 94 is mounted to the canopy 14 in a "bayonet" fashion and is locked in place by the bolt 266 in the cover plate 94. After the canopy 14 is mounted to a junction box, as outlined above, the cover plate 94 is positioned adjacent the canopy 14 such that the first set of tabs 212, 214 is disposed adjacent the distal end 300 of canopy 14, the second set of tabs 216, 218 is disposed adjacent the slots 292 in the center portion 272 of the canopy 14, and bearing member 270 is disposed adjacent the proximal end 290 of the canopy 14. The cover plate 94 is placed over the canopy 14 such that the second set of tabs 216, 218 are inserted through slots 292. The cover plate 94 is then "bayonet" mounted to the canopy 14 by moving the cover plate 94 longitudinally until the first set of tabs 212, 214 engages the first spacer segment 278 and the second set of tabs 216, 218 engages the third spacer segment 286. To lock the cover plate 94 in the mounted position, bolt 266 is torqued until the bearing member 270 engages the bearing portion proximal end 290 of the canopy 14.

The light module 18 includes a circuit board 76 having an electrical circuit etched thereon. An auxiliary power supply 20, preferably in the form of a rechargeable nickel cadmium battery is mounted to the top surface 78 of the circuit board 76 by at least one, battery mount 302. A pair of wires 304 electrically connect the auxiliary power supply 20 to the circuit board 76. Multiple LEDs 82 are mechanically and electrically mounted to the circuit board 76 such that each LED 82 depends from the bottom surface 84 of the circuit board 76, whereby light emitted by the LEDs 82 is efficiently transmitted through opening 48 to illuminate stencil 32. The other circuit components 80, such as resistors, capacitors, etc. may be mounted on either side of the circuit board 76, as surface space and the size of the circuit components permit.

The laterally extending side edge portions 74 of the circuit board 76 are received in the channels 70 of the container 42 to mount the circuit board 76 therein. Three male pins 88 are etched into the distal end portion 90 of the circuit board 76 and are received within cooperating female receptacles of electrical connector 86 to connect the circuit board 76 to the building power supply circuit which is the primary power supply for the sign 10. The circuit of the circuit board 76, the LEDs 82, and the other circuit components 80 are positioned on the circuit board 76 such that the circuit board 76 must be moved longitudinally within the channels 70 a sufficient distance to disengage the male pins 88 from the female receptacles, and thereby break the electrical connection between the building power supply circuit and the circuit board 76, before any portion of the circuit or any of the LEDs 82 or circuit components 80 are withdrawn from the container 42. Consequently, the circuit board 76 may be removed from the sign 10 without securing power to the sign and without presenting a personnel safety hazzard.

An endcap 306 is mechanically mounted to the proximal end 308 of the circuit board 76, preferably by a pair of screws 310. A LED indicator 312 electrically connected to the circuit board 76 is mounted within a lens 314 which is fixed to the center of the endcap 306 such that the lens 314 extends through an opening 316 in the center of access door 52. A pushbutton 318 extends longitudinally through the endcap 306 and is pivotally mounted thereto. The distal end 320 of the pushbutton 318 is disposed proximate to a switch 322 for activating a test circuit of the light module 18. The proximal end 324 of the pushbutton 318 is disposed proximate to the inner surface 326 of the lower end 328 of the access door 52. Pushing the lower end 328 of the access door 52 inwards causes the pushbutton 318 to be pivoted longitudinally such that the distal end 320 contacts switch 322 and thereby activates the test circuitry. LED 312 provides a visible indication of successful testing. Alternatively, lens 314 acts as a light pipe when illuminated by a conventional laser pen (not shown) to transmit a light signal to a light sensor mounted on the circuit board 76 and thereby activate the test circuit.

Figure 11:
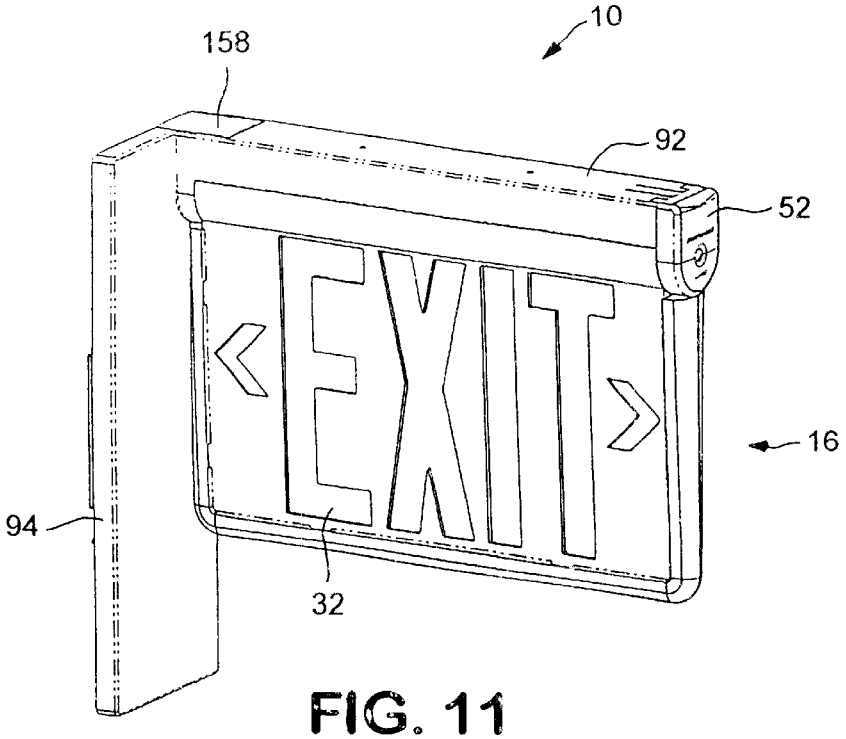
FIG. 11 is perspective view of the exit sign of FIG. 2, illustrating the cover plate in the end mount position.

The cover plate 94 may be mounted to the swivel mounting member 92 either the top mount position (FIGS. 12*a* and 12*b*) or the end mount position (FIG. 11). The top mount position is appropriate if the canopy 14 mounted to a vertical wall, a horizontal ceiling, or a sloped ceiling/wall. The end mount position is appropriate only if the canopy 14 mounted to a vertical wall.

With reference to FIGS. 3 , 12*a*, 12*b*, and 13, the cover plate 94 is mounted to the swivel mounting member 92 in the top mount position by two screws 228 which are inserted through the openings 224 in plate 204 and threadably engage the inner surface of the bores 226 in posts 102. Wires 148 extend upwardly through the top segment 144 of opening 142 in the swivel mounting member 92 and the second opening 248 in the cover plate 94. Cut-outs 330 in the stiffening elements 208 provide a passage for the wires 148 connected to the connector 86 and the wires of the building electrical system, whereby the ends of the appropriate wires may be connected by conventional means to complete the electrical supply circuit to the sign 10. Trim door 158 is in the vertical position such that the outer surface 172 of the trim door 158 is substantially co-planar with the outer surface 138 of the first swivel mount 98 and the first pair of tabs 170 are positioned in grooves 160. The second pair of tabs 174 of the trim door 158 are disposed within a pair of notches 247 at the first end portion 234 of the cover plate 94. After the cover plate 94 is bayonet mounted to the canopy 14 and the housing 16 is swivelled to the desired orientation, a screw 332 may be driven into an opening 334 in the frame 178 of the access door assembly 176 such that the screw 332 threadably engages the outer surface 336 of the container 42 to lock the housing 16 in position. Preferably, the sign 10 is sold with the cover plate 94 mounted in the top mount position since this arrangement provides the greatest degree of flexibility for mounting the sign 10.

Figure 14:
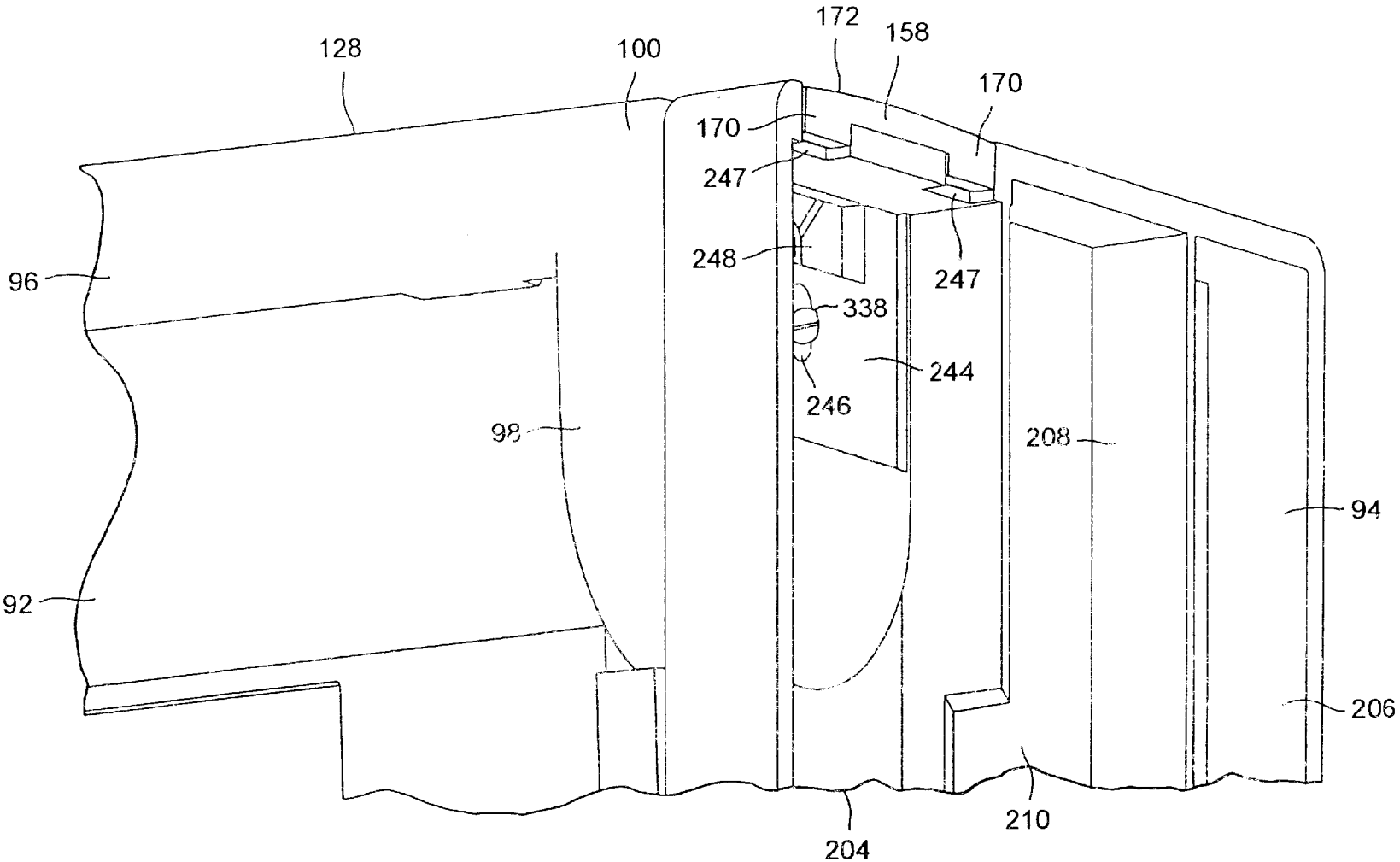
FIG. 14 is an enlarged, partial, perspective view of the cover plate mounted to the light module housing in the end mount position.

With reference to FIGS. 11 and 14, the cover plate 94 is mounted to the swivel mounting member 92 in the end mount position by positioning the outer surface 138 of the first swivel mount 98 within the recess 232 of the cover plate 94, inserting a single screw 338 through the first opening 246 in platform 244 of the cover plate 94 and torquing the screw 338 such that it threadably engages the inner surface of the slot 164 in platform 162 of the swivel mounting member 92. Trim door 158 is in the horizontal position such that the outer surface 172 of the trim door 158 is substantially co-planar with the upper surface 128 of the platform 96 and the second pair of tabs 174 are positioned in grooves 150. The first pair of tabs 170 of the trim door 158 are disposed within the notches 247 of the cover plate 94. Wires 148 extend longitudinally through the side segment 146 of opening 142 in the swivel mounting member 92 and the second opening 248 in the cover plate 94 for connection to the building electrical service wires in the manner described above.

A canopy mounting plate 340 may be mounted to the swivel member 92 in place of the cover plate 94 and the mounting canopy 14 by screws 228 if the sign 10 is to be canopy mounted. A pair of notches 342 in the upper surface 344 of the canopy mounting plate 340 receive the second pair of tabs 174 of the trim door 158 to further lock the canopy mounting plate 340 to the swivel member 92. The canopy mounting plate 340 includes means for receiving a mechanical mounting member of the building electrical system. A pipe (not shown) enclosing the electrical system wires is threadably mounted to a threaded opening 346 in the center of the canopy mounting plate 340. The electrical system wires are connected to wires 148 in a conventional manner in an enclosure formed by the canopy mounting plate 340.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An emergency sign for use with an external electrical supply, the sign comprising:

a vertically extending sign body including a lower panel portion having laterally spaced right and left panels, at least one of the panels defining a stencil forming a display, and an upper container portion in optical communication with the display and defining a longitudinally extending container having oppositely disposed first and second ends and an endcap mounted proximate to the first end, the endcap including an electrical connector having a plurality of female electrical receptacles;

a light module disposed within the container portion of the sign body the light module being adapted for electrically communicating with the external electrical supply and including a plurality of light emitting diodes for illuminating the display and a circuit board having a proximal end and a distal end portion including a plurality of male electrical pins;

a swivel mounting assembly pivotally connected to the container portion of the sign body; and a mounting plate assembly mounted to the swivel mounting assembly, the mounting plate assembly being adapted for receiving a mechanical mounting member of the external electrical supply;

wherein the female electrical receptacles are positioned to engage the male electrical pins of the circuit board.

2. The sign of claim 1 wherein the container of the sign body also has an inner surface including right and left side surfaces defining oppositely disposed, longitudinally extending channels and wherein the circuit board also has oppositely disposed, longitudinally extending side edges, the side edges of the circuit board being slidingly received in the channels of the container to mount the light module within the container.

3. The sign of claim 2 wherein the right and left side surfaces of the container each have a pair of upper and lower longitudinally extending lips defining the channels of the container, each pair of lips having oppositely disposed end portions, the end portions of each upper and lower lip extending upwardly and downwardly, respectively, whereby each channel flares open toward an adjacent end of the container.

4. The sign of claim 1 wherein the right and left panels of the panel portion define a chamber therebetween and the container portion further defines a longitudinally extending opening providing optical communication between the container and the chamber, the circuit board having upper and lower surfaces, the light emitting diodes depending from the lower surface of the circuit board to a position proximate to the opening of the container.

5. An emergency sign for use with an external electrical supply, the sign comprising:

a vertically extending sign body including a lower panel portion having laterally spaced right and left panels, at least one of the panels defining a stencil forming a display, and an upper container portion in optical communication with the display and defining a longitudinally extending container having oppositely disposed first and second ends and an endcap mounted proximate to the first end, the endcap including a first electrical connector;

a light module disposed within the container portion of the sign body, the light module being adapted for electrically communicating with the external electrical supply and including a circuit board having a proximal end and a distal end portion including a second electrical connector adapted for engaging the first electrical connector, a plurality of light emitting diodes for illuminating the display, an electrical circuit and a plurality of other circuit components, the electrical circuit, the light emitting diodes, and the other circuit components being positioned on the circuit board at a distance from the proximal end, wherein the circuit board must be moved longitudinally a sufficient distance to disengage the second electrical connector from the first electrical connector before the electrical circuit, the light emitting diodes, or the other circuit components are withdrawn from the container;

a swivel mounting assembly pivotally connected to the container portion of the sign body; and a mounting plate assembly mounted to the swivel mounting assembly, the mounting plate assembly being adapted for receiving a mechanical mounting member of the external electrical supply.

6. An emergency sign for use with an external electrical supply, the sign comprising:

a vertically extending sign body including a lower panel portion having laterally spaced right and left panels, at least one of the panels defining a stencil forming a display, and an upper container portion in optical communication with the display and defining a longitudinally extending container having oppositely disposed first and second ends;

a light module disposed within the container portion of the sign body, the light module being adapted for electrically communicating with the external electrical supply and having a plurality of light emitting diodes for illuminating the display;

a swivel mounting assembly pivotally connected to the container portion of the sign body and including a swivel mounting member comprising a longitudinally extending platform having oppositely disposed first and second ends, first and second end portions, and an integral first swivel mount extending laterally from the first end portion, and a second swivel mount mounted to the second end portion, the first and second swivel mounts each having at least one positioning tab extending longitudinally into the first and second ends of the container, respectively, to pivotally mount the swivel mounting assembly to the sign body; and a mounting plate assembly mounted to the swivel mounting assembly, the mounting plate assembly being adapted for receiving a mechanical mounting member of the external electrical supply.

7. The sign of claim 6 wherein the platform of the swivel mounting member has a lower bearing surface disposed proximate to the positioning tab of the first swivel mount, the first end of the container being received between the bearing surface and the positioning tab of the first swivel mount.

8. The sign of claim 6 wherein the platform of the swivel mounting member has oppositely disposed first and second side edge portions and first and second skirts extend laterally downward from the side edge portions, each of the skirts having height, the height of the first skirt being greater than the height of the second skirt.

9. The sign of claim 6 wherein the container further has an electrical connector mounted proximate to the first end, the electrical connector having a plurality of wires adapted for connection to wires of the external electrical supply, the first swivel mount having inner and outer surfaces, and the platform of the swivel mounting member having an upper surface, the first end portion of the platform defining an opening having a top and side segments extending through the platform and first swivel mount, respectively, the inner surface of the first swivel mount defining a trough extending laterally upward into the opening, the wires of the electrical connector being received in the trough and extending through the opening.

10. The sign of claim 9 wherein the first end portion of the platform defines a recess having a top segment in the upper surface extending from the first end of the platform, and a side segment in the outer surface of the first swivel mount, respectively, the opening providing communication between the trough and the recess, the wires extending through the opening being received in the recess.

11. The sign of claim 10 wherein the swivel mounting assembly further includes a trim door pivotally mounted within the recess of the platform, the top segment of the recess has a floor defining a first pair of grooves disposed on either side of the top segment of the opening, and the side segment of the recess has a wall defining an aperture and a second pair of grooves, the trim door having an outer surface, oppositely disposed first and second end portions, and first and second pairs of tabs extending laterally from the first and second end portions, respectively, the trim door being pivotally moveable between vertical position and a horizontal position.

12. The sign of claim 11 wherein the mounting plate assembly comprises a cover plate including a longitudinally extending plate and a peripheral lip extending upwardly from the plate, the lip having an outer surface, the plate including a first end portion and a lower surface defining a recess having a bottom segment extending upwardly from the lower surface of the plate and a side segment in the outer surface of the lip, the bottom segment of the recess defining first and second openings, the lip defining a pair of notches disposed within the side segment of the recess.

13. The sign of claim 12 wherein the first swivel mount has a shape and the recess of the cover plate has a shape with is the mirror image of the shape of the first swivel mount, the cover plate being mountable to the swivel mounting member in an end mount position wherein the trim door is pivoted to the horizontal position, whereby the second pair of tabs of the trim door is received in the first pair of grooves of the swivel mounting member and the outer surface of the trim door is substantially coplanar with the upper surface of the platform, the wires of the electrical connector are inserted through the second opening of the recess, the first swivel mount is inserted into the recess of the cover plate, whereby the first pair of tabs of the trim door are inserted into the notches of the cover plate, and the cover plate is locked to the swivel mounting member by a screw inserted through the first opening of the cover plate and torqued into threaded engagement with the aperture of the swivel mounting member.

14. A The sign of claim 12 wherein the plate of the cover plate defines at least one aperture and the platform of the swivel mounting member includes a lower surface and at least one post extending from the lower surface, the post defining a bore, the cover plate being mountable to the swivel mounting member in a top mount position wherein the trim door is pivoted to the vertical position, wherein the first pair of tabs is received in the second pair of grooves of the swivel mounting member and the outer surface of the trim door is substantially coplanar with the outer surface of the first swivel mount, the aperture of the cover plate is positioned over the bore in the post of the swivel mounting member, whereby the second pair of tabs is inserted into the notches of the cover plate, and the cover plate is locked to the swivel mounting member by a screw inserted through the aperture of the cover plate and torqued into threaded engagement with the bore of the swivel member.

15. The sign of claim 6 wherein the second end portion of the platform comprises a longitudinally extending catch and defines at least one notch extending longitudinally from the first end of the platform and the second swivel mount comprises an access door assembly including a door frame and the access door, the access door having an upper portion pivotally mounted to the door frame and a lower portion including a longitudinally extending catch, the catch being engageable with the door frame to lock the access door in a closed position, the door frame having a circular lip extending longitudinally within the second end of the container of the sign body, at least one longitudinally indexing tab received within the notch of the second end portion of the platform, and a receptacle engaged with the catch of the second end portion of the platform, whereby the door frame locks the swivel mounting member to the container.

16. An emergency sign for use with an external electrical supply, the sign comprising:

a vertically extending sign body including a lower panel portion having laterally spaced right and left panels, at least one of the panels defining a stencil forming a display, and an upper container portion in optical communication with the display and defining a longitudinally extending container;

a light module disposed within the container portion of the sign body, the light module being adapted for electrically communicating with the external electrical supply and having a plurality of light emitting diodes for illuminating the display;

a swivel mounting assembly pivotally connected to the container portion of the sign body; and a mounting plate assembly mounted to the swivel mounting assembly, the mounting plate assembly being adapted for receiving a mechanical mounting member of the external electrical supply, the mounting plate assembly comprising a cover plate and a canopy, the cover plate including a longitudinally extending plate, a peripheral lip extending upwardly from the plate, and first and second pairs of oppositely disposed tabs extending inwardly from an upper edge of the lip, the plate having an inner surface, the lip and inner surface of the plate forming a receptacle, the canopy having oppositely disposed sides and a center portion disposed intermediate first and second end portions, the center portion defining at least one opening adapted for receiving the mechanical mounting member of the external electrical supply, the first and second end portions being in engagement with the first and second pairs of tabs, respectively, whereby the canopy is mounted within the cover plate.

17. The sign of claim 16 wherein the second end portion of the canopy extends from the center portion to a proximal end, the cover plate further includes a nut mounted to the inner surface of the plate and a bolt threadably engaged with the nut, the nut having a shaft end, the shaft end being threadably positionable to engage the proximal end of the canopy, whereby the cover plate is locked to the canopy.

18. An emergency sign for use with an external electrical supply, the sign comprising:

a vertically extending sign body including a lower panel portion having laterally spaced right and left panels, at least one of the panels defining a stencil forming a display, and an upper container portion in optical communication with the display and defining a longitudinally extending container;

a light module disposed within the container portion of the sign body, the light module being adapted for electrically communicating with the external electrical supply and having a plurality of light emitting diodes for illuminating the display, a circuit board having a proximal end and an electrical circuit, an auxiliary power supply in electrical communication with the circuit board, and an endcap mounted to the proximal end of the circuit board, the electrical circuit including test circuitry, the endcap including a lens and a light emitting diode disposed within the lens, the light emitting diode being in electrical communication with the electrical circuit, wherein the light emitting diode provides visible indication of proper operation of the sign;

a swivel mounting assembly pivotally connected to the container portion of the sign body; and a mounting plate assembly mounted to the swivel mounting assembly, the mounting plate assembly being adapted for receiving a mechanical mounting member of the external electrical supply.

19. The sign of claim 18 wherein the light module includes a light sensor in electrical communication with the test circuitry and the swivel mounting assembly includes an access door disposed proximate to the endcap, the access door defining an opening, the lens having a body extending from a distal end disposed proximate to the light sensor through the opening, the body of the lens being a light pipe adapted for receiving light signals and transmitting the light signals to the light sensor, whereby the light sensor activates the test circuitry on receipt of a light signal.

20. The sign of claim 18 wherein the circuit board further has a test circuit activation switch in electrical communication with the test circuitry, the swivel mounting assembly includes an access door pivotally mounted to the container proximate to the endcap, the endcap defines an opening, and the light module further has a pushbutton extending from a distal end disposed proximate to the test circuit activation switch through the opening in the endcap to a proximal end disposed proximate to the access door, wherein the pushbutton is pivotally movable by the access door to contact the test circuit activation switch whereby the test circuitry is activated.

21. An emergency sign for use with an external electrical supply, the sign comprising:

a vertically extending sign body including a lower panel portion having laterally spaced right and left panels, at least one of the panels defining a stencil forming a display, and an upper container portion defining a longitudinally extending container in optical communication with the display, the container comprising oppositely disposed first and second ends, an inner surface having right and left side surfaces defining oppositely disposed, longitudinally extending channels and an electrical connector mounted proximate to the first end, the electrical connector having a plurality of female electrical receptacles adapted for providing electrical communication with the external electrical power supply, a swivel mounting assembly pivotally connected to the container portion of the sign body;

a mounting plate assembly mounted to the swivel mounting assembly, the mounting plate assembly being adapted for receiving a mechanical mounting member of the external electrical supply; and a light module disposed within the container, the light module comprising a circuit board, an electrical circuit carried on the circuit board, a plurality of light emitting diodes, and at least one circuit component, the circuit board having oppositely disposed, longitudinally extending side edges and oppositely disposed proximal and distal ends, the distal end portion including a plurality of male electrical pins, the side edges of the circuit board being slidingly received in the channels of the container to mount the light module within the container, the male pins being positioned for engagement by the female receptacles of the electrical connector, the electrical circuit, light emitting diodes, and circuit component being positioned on the circuit board at a distance from the proximal end;

wherein the circuit board must be moved longitudinally a sufficient distance to disengage the male pins from the female receptacles before the electrical circuit, the light emitting diodes, or the other circuit components are withdrawn from the container.

22. An emergency sign for use with an external electrical supply, the sign comprising:

a vertically extending sign body including a lower panel portion having laterally spaced right and left panels, at least one of the panels defining a stencil forming a display, and an upper container portion in optical communication with the display and defining a longitudinally extending container having oppositely disposed first and second ends;

a light module disposed within the container portion of the sign body, the light module being adapted for electrically communicating with the external electrical supply and having a plurality of light emitting diodes for illuminating the display;

a swivel mounting assembly comprising a swivel mounting member and a second swivel mount, the swivel mounting member including a longitudinally extending platform having oppositely disposed first and second ends, first and second end portions, and an integral first swivel mount extending laterally from the first end portion, the second swivel mount being mounted to the second end portion of the swivel mounting member, the first and second swivel mounts each having at least one positioning tab extending longitudinally into the first and second ends of the container, respectively, to pivotally mount the swivel mounting assembly to the sign body; and a mounting plate assembly mounted to the swivel mounting assembly, the mounting plate assembly being adapted for receiving a mechanical mounting member of the external electrical supply.

* * * * *